US005805969A

United States Patent [19]

Elsermans et al.

[11] Patent Number: 5,805,969

[45] Date of Patent: Sep. 8, 1998

[54] ELECTROSTATOGRAPHIC PRINTER FOR IMPARTING A MODIFIED FINISH TO A TONER IMAGE

[75] Inventors: Johan Denise Gustave Elsermans, Antwerp; Wim Jacques Josephine Michielsen, Wommelgem; Jean Alois Rachel Norbert Van Daele, Bonheiden, all of Belgium

[73] Assignee: Xeikon N.V., Mortsel, Belgium

[21] Appl. No.: 692,724

[22] Filed: Aug. 6, 1996

Related U.S. Application Data

[60] Provisional application No. 60/018,351, May 13, 1996.

[30] Foreign Application Priority Data

Aug. 10, 1995 [EP] European Pat. Off. ..... 95305580
Apr. 26, 1996 [GB] United Kingdom ..... 9608761

[51] Int. Cl.[6] ..... G03G 15/20

[52] U.S. Cl. ..... 399/341; 399/321; 399/322; 430/126

[58] Field of Search ..... 399/320, 321, 399/322, 328, 329, 330, 335, 336, 338, 341, 342; 430/97, 99, 124, 126

[56] References Cited

U.S. PATENT DOCUMENTS

| | | | |
|---|---|---|---|
| 5,023,038 | 6/1991 | Aslam et al. | 264/293 |
| 5,085,962 | 2/1992 | Aslam et al. | 430/99 |
| 5,089,363 | 2/1992 | Rimai et al. | 430/45 |
| 5,112,717 | 5/1992 | Baxter et al. . | |
| 5,118,589 | 6/1992 | Aslam et al. | 430/124 |
| 5,132,198 | 7/1992 | Tamary | 430/124 |
| 5,196,894 | 3/1993 | Merle et al. . | |
| 5,210,580 | 5/1993 | Aslam et al. | 399/328 |
| 5,339,146 | 8/1994 | Aslam et al. | 399/342 |
| 5,455,668 | 10/1995 | De Bock et al. . | |
| 5,461,470 | 10/1995 | Cock et al. | 399/228 |
| 5,506,671 | 4/1996 | Buts et al. | 399/39 |
| 5,521,688 | 5/1996 | Moser . | |
| 5,526,108 | 6/1996 | Billet et al. . | |

FOREIGN PATENT DOCUMENTS

| | | |
|---|---|---|
| A629924 | 12/1994 | European Pat. Off. . |
| A629930 | 12/1994 | European Pat. Off. . |
| 2225059 | 11/1973 | Germany . |
| 61-230181 | 10/1986 | Japan . |
| 06075490 | 3/1994 | Japan . |
| A2180948 | 4/1987 | United Kingdom . |
| WO-A9100548 | 1/1991 | WIPO . |

OTHER PUBLICATIONS

"Principles of Non Impact Printing" by Jerome L. Johnson –Palatino Press Irvine Ca, 92715 U.S.A. (1986), pp. 64–95).

*Primary Examiner*—Matthew S. Smith
*Attorney, Agent, or Firm*—Baker & Botts, L.L.P.

[57] ABSTRACT

An electrostatographic printer is provided in which a web of receiving material (12) is fed along a web path, at least one toner image is formed on at least a first face of the receiving material (12) as it is fed along the web path and the toner image is fixed onto the receiving material (12). A finishing element (66, 67) positioned downstream of the fixing station (16) contacts the first face of the receiving material (12) while the finishing element is at a temperature above the glass transition temperature $T_g$ of the toner to modify the finish of the toner image.

16 Claims, 9 Drawing Sheets

ELECTROSTATOGRAPHIC PRINTER FOR IMPARTING A MODIFIED FINISH TO A TONER IMAGE

SPECIFICATION

As to an invention which is claimed herein and which is also disclosed in U.S. provisional application Ser. No. 60/018,351, filed May 13, 1996, the claimed invention is entitled to the benefit of the filing date of the provisional application.

FIELD OF THE INVENTION

This invention relates to an electrostatographic printer and to a method of printing images.

BACKGROUND OF THE INVENTION

Electrostatographic printers are known in which receiving material, such as paper, is fed along a path past one or more image forming devices where toner images are formed on at least one surface thereof. The toner images are then fixed onto the receiving material.

Printers are known in which the receiving material is in the form of a web. For example EP-A-629930 (Xeikon NV) uses a receptor material in the form of a web while EP-A-629924 (Xeikon NV) describes a multi-color duplex printer in which toner images are formed on both sides of a web of receiving material. The toner images are then fixed onto the receiving material by radiant fixing devices.

The result of this printing method is to produce images with a matt appearance and these images usually have a low color saturation. While this appearance is acceptable for many applications, it is sometimes desired to provide an image having a different appearance or finish. By the term "finish" in the context of the present invention, we mean either a surface characteristic which is glossy, i.e. highly reflective, or which provides high saturation of colors, this usually being achieved by reducing the scattering of light from the surface of the printed article, or both such characteristics. For example, a glossy appearance is especially desirable where the receiving material itself has a glossy surface. A higher degree of color saturation can be very desirable in high quality print work.

It has been proposed to provide glossy images by the use of a toner which incorporates a glossing agent, or by the application of a transparent glossing layer over the toner image. However, these methods are costly in terms of consumables.

SUMMARY OF THE INVENTION

It is an object of the present invention to provide a printer, and a method of printing, in which toner images with modified finish can be produced in a simple and convenient manner.

We have discovered that this objective can be achieved by the treatment of the receiving material web in a specified manner after passing the fixing device.

According to a first aspect of the invention, there is provided an electrostatographic printer comprising:

means for feeding a web of receiving material along a web path;

at least one toner image forming device for forming at least one toner image on at least a first face of receiving material as it is fed along the web path; and fixing means for fixing the toner image onto the receiving material, characterized by at least one finishing element positioned downstream of the fixing means, to contact the first face of the receiving material while the contacting surface of the toner image is at a temperature above the glass transition temperature $T_g$ of the toner to modify the finish of the toner image.

We have found that it is not always possible to obtain the desired toner finish by use of the fixing means alone, even if roller fixing is used. While not wishing to be bound by theory, it appears that a separate contact with a finishing element while the toner surface is above the toner glass transition temperature, especially together with moderate pressure, is necessary to transform the toner surface in a desirable manner.

Contact between the web and the finishing element is essential. We prefer a rolling contact, to avoid any significant slip between the web and the finishing element. Thus, the finishing element is preferably an endless surface, such as the surface of a roller or a continuous belt. In the following general description, reference is made to finishing rollers, but it is to be understood that such references are also applicable to endless belts or to any other form of endless surface means. We have found that an average contact pressure over the contact area of from 2 to 20 N/cm$^2$, such as from 5 to 10 N/cm$^2$ is preferred. In particular, it is preferred that the contacting force at each end of the finishing element be from 20 to 200N. The finishing roller will usually be a pair of freely rotating, i.e. non-driven rollers.

Where the finishing element is a finishing roller, sufficient contact between the finishing roller and the web may be achieved by providing a backing roller biased into contact with the finishing roller to form a nip therebetween, through which the web passes. Two or more such finishing rollers, each with its associated backing roller, may be used. Alternatively, the geometry of the web path may be such that the web contacts the finishing roller over a finite angle, tension in the web being sufficient to generate the necessary contact pressure.

The invention may be carried out according to one of two possible principles. According to the first principle, the finishing roller is positioned immediately downstream of the fixing means and contacts the web of receiving material while the temperature of at least the top surface of the toner image is above $T_g$. According to the second principle, the web of receiving material is cooled after leaving the fixing means to bring at least the top surface of the toner image to a temperature below $T_g$, and the finishing roller is heated to return at least the top surface of the toner image to a temperature above $T_g$. The second principle leads to an advantage in terms of the temperature profile through the thickness of the receiving material, finishing taking place while the temperature of the top surface of the toner image is higher than that of the interior of the receiving material.

Whether the finishing rollers are heated or cooled, the printer may further comprise means for controlling the heat output, or the cooling thereof, respectively. The temperature of the rollers should not be so high that toner is transferred from the receiving material to the surface of the rollers, to be deposited on a following location on the receiving material, thereby producing hot offset artifacts. Thus, the temperature of the rollers is preferably controlled not to exceed 10° C. above the glass transition temperature ($T_g$) of the toner at the point where the paper breaks contact with the roller surface.

In one embodiment of the first principle of the invention, the finishing roller is positioned immediately downstream of the fixing means. In this embodiment the printer may further comprise cooling means for cooling the finishing roller. Such cooling means may comprise means for blowing cold air onto the outside surface of the finishing roller. Alternatively, in the case where the finishing roller is hollow, a cooling fluid such as cold air or a liquid coolant may be passed through the hollow interior of the roller. As a further alternative, a cooling liquid such as purified water may be applied to the outside surface of the finishing roller.

The invention is applicable to printers, such as multi-color printers, comprising a plurality of toner image forming devices positioned on the same side of the web path for forming overlapping images on the first face of the receiving material, the fixing means being positioned downstream of the toner image forming devices.

The invention is also particularly applicable to printers capable of forming toner images on both faces of a web of receiving material, i.e. "duplex" printers. Such printers preferably comprise two toner image forming devices positioned one on either side of the web path for forming images on both faces of the receiving material, and according to the invention further comprise a pair of finishing rollers with the web path extending between them.

The pair of finishing rollers may be provided adjacent one another and biased towards each other to define a nip there-between, through which the web path extends and to provide the necessary contact pressure. This arrangement is particularly convenient where the finishing rollers are located immediately following the radiant fixing means, and the web of receiving material is to contact the finishing rollers before the temperature of the toner falls below its glass transition temperature ($T_g$).

Alternatively, one of the pair of finishing rollers may be provided upstream of the other, the web taking a serpentine path around these rollers. In this case the necessary contact pressure derives from the tension in the web and the geometry of the arrangement. This arrangement is particularly convenient when the web contacts the first finishing roller before the temperature of the toner falls below its glass transition temperature ($T_g$) and an intermediate web heating device is provided between the finishing rollers. However, this arrangement is generally more demanding on space.

Whether the finishing rollers are provided adjacent each other, or spaced one upstream from the other, the web needs to contact the surface thereof over a finite distance, to allow sufficient time for the top surface of the toner to cool to a temperature low enough to allow easy release from the finishing rollers. The optimum length of this contact distance will depend inter alia upon the speed of the moving web and its temperature profile as it makes and breaks contact with the finishing element. Where the finishing element is a belt, the required contact distance is provided by the length of that part of the belt which is contacted by the web. Where the finishing element is a roller, the required contact distance can be achieved by the web being in contact therewith over a finite contact angle. Alternatively, in the case of a pair of rollers biased together to form a nip, the required contact distance can be achieved by ensuring that the elastomeric properties of the rollers and the bias force are such as to form a nip of sufficient length. Where the web starts making contact with the finishing rollers while the web is at a temperature above the glass transition temperature $T_g$, this temperature is preferably at least 45° C. above $T_g$, typically within the range of 100° to 140° C. The web should however break contact with the finishing rollers at a temperature which is preferably not more than 10° C. above $T_g$, typically within the range of 50° C. to 95° C.

In an embodiment according to the second principle, the finishing roller is a heated finishing roller.

According to an embodiment of the second principle of the invention, the printer further comprises cooling means positioned between the fixing means and the finishing elements to cool the top surface of the toner image, thereby to reduce or prevent hot offset, for example to cool the top surface of the toner image to a temperature below the glass transition temperature $T_g$ of the toner prior to contact with the finishing element and further comprises heating means for heating the finishing means.

In this alternative embodiment, particularly adapted for use with "duplex" printing, the web leaving the fixing station may pass over a pair of cooling rollers whereby each face of the web is cooled so as to bring the temperature of the toner image thereon below the glass transition temperature of the toner. These cooling rollers may be hollow grounded metal rollers carrying a conductive elastomeric coating such as silicone rubber. Fans may be provided to blow cold air through the interiors of such hollow cooling rollers.

In this embodiment, the finishing station may comprise two parts, a first pair of finishing rollers being provided at the entry of the finishing station and a second pair of finishing rollers being provided at the exit of the finishing station. The housing parts may be biased towards each other, for example by springs, thereby biasing the finishing rollers of each pair into contact with each other to form a nip through which the web extends.

While the finishing roller may be heated by exposing the outside surface thereof to heating means, in the case of a hollow finishing roller an alternative is to pass a heating fluid through the hollow interior of the roller, or to mount a radiant heating device within the hollow interior. For example, each finishing roller may be provided with heating means such as a radiant heater. Temperature sensors may be provided to measure the temperature of the surface of at least one finishing roller of each pair. These temperature sensors are preferably coupled to the controllable power supply means for the radiant heaters.

A particular advantage may be gained by external heating of the finishing rollers, especially where they are made of a generally heat non-conductive material, such as silicone rubber. By external heating, the temperature of the interior of the roller is lower than would be the case with internal heating. The silicone rubber is thereby subjected to lower thermal stress, resulting in longer lifetime and/or avoiding the need to include any heat conductive ingredients in the silicone material. Response times are also faster, enabling more accurate control of the roller surface temperature.

While the present invention reduces the use of consumables, the application of a release agent to the finishing rollers is not excluded. Thus, each finishing roller may optionally also be provided with a lubricating roller for applying a release agent, such as a silicone oil, to the surface of the finishing rollers. The temperature of the surface of the finishing rollers is so controlled as to contact the surface of the web at a temperature above the glass transition temperature $T_g$ of the toner to modify the finish of the toner image.

The printer may also further comprise means for cooling the opposite face of the receiving material while the first face of the receiving material contacts the finishing element. Thus, in a modification of the embodiment referred to above, the web leaving the fixing station firstly passes over an advance cooling roller, whereby one face of the web is cooled to bring the temperature of the toner image thereon below the glass transition temperature of the toner. The web then enters the finishing station which comprises two housing parts, in each of which can be found a pair of finishing rollers and an opposed cooling roller. The housing parts may be biased towards a fixed part of the apparatus, for example by springs, thereby biasing the finishing rollers into contact with the opposed cooling roller to form nips through which the web extends.

Where one finishing roller is upstream of the other, i.e. the finishing rollers are not biased towards each other to form a nip there-between, each finishing roller may be provided with electrostatic charging means, such as a corona, to provide an electrostatic charge on the surface of the receptor material as it makes contact with the finishing roller. This arrangement increases the force with which the receptor material is held against the surface of the finishing roller. Cleaning means, such as a cleaning brush, may also be provided to remove any toner particles from the surface of the finishing roller after release of the receptor material from the surface thereof.

Usually web cooling means will be positioned downstream of the finishing rollers, ideally immediately downstream thereof, so that the temperature of the toner is reduced below the glass transition temperature ($T_g$) of the toner as quickly as possible. However, where the finishing rollers are cooled, separate web cooling means may prove to be unnecessary.

Preferably, the finishing roller is provided with a non-abhesive, i.e. adhesive web-contacting surface, such as a smooth metal surface or a surface coated with polytetrafluoroethylene (e.g. TEFLON—Trade Mark—ex Dupont).

The finishing rollers may comprise a rigid core provided with a covering of elastomeric material, such as silicone rubber or EPDM (ethylene-propylene elastomer).

In a preferred embodiment of the invention, the toner image forming device comprises at least one imaging station positioned adjacent the web path and including rotatable endless surface means, means for applying an electrostatic latent image to the rotatable endless surface means, developing means for developing the electrostatic latent image into a toner image (usually by way of magnetic brush technology), and transfer means for transferring the toner image from the endless rotatable surface means to the receiving material.

In a preferred embodiment of the present invention, the printer comprises a plurality of toner image forming devices, adapted to apply images of different colors onto the receiving material, i.e. a multi-color printer.

The developing means comprises a developer which contains toner particles containing a mixture of a resin, a dye or pigment of the appropriate color and normally a charge-controlling compound giving triboelectric charge to the toner. In dual-component developers which are normally used, carrier particles are also present for charging the toner particles by frictional contact therewith. The carrier particles may be made of a magnetizable material, such as iron or iron oxide. In mono-component developers, the carrier particles are not present, the toner particles themselves containing a magnetizable material, or else a developing technology other than magnetic brush development is used.

Dry-development toners essentially comprise a thermoplastic binder consisting of a thermoplastic resin or mixture of resins including coloring matter, e.g. carbon black or coloring material such as finely dispersed dye pigments or soluble dyes.

The mean diameter of dry toner particles for use in magnetic brush development is about 10 $\mu$m (ref. "Principles of Non Impact Printing" by Jerome L. Johnson—Palatino Press Irvine Calif., 92715 U.S.A. (1986), p. 64–85), but may be from 1 to 5 $\mu$m for high resolution development (see e.g. British patent specification GB-A-2180948 and International patent specification WO-A-91/00548).

The toner particles contain in the resinous binder a colorant (dissolved dye or dispersed pigment) which may be white or black or has a color of the visible spectrum, not excluding however the presence of infra-red or ultra-violet absorbing substances and substances that produce black in admixture.

White toner images may be used on colored printing stock or transparent receptor material e.g. for the production of back-lightened transparent advertising panels.

The thermoplastic resinous binder may be formed of polyester, polyethylene, polystyrene and copolymers thereof, e.g. styrene-acrylic resin, styrene-butadiene resin, acrylate and methacrylate resins, polyvinyl chloride resin, vinyl acetate resin, copoly(vinyl chloride-vinyl acetate) resin, copoly(vinyl chloride-vinyl acetate-maleic acid) resin, vinyl butyral resins, polyvinyl alcohol resins, polyurethane resins, polyimide resins, polyamide resins and polyester resins. Polyester resins are preferred for providing high gloss and improved abrasion resistance. Such resins usually have a glass transition point of more than 45° C. with a melt viscosity of at least 500 poise up to no more than 15000 poise. The presence of other ingredients in the toner particles, such as the colorant, usually have no significant effect upon the glass transition temperature. The volume resistivity of the resins is preferably at least $10^{13}$ Ω-cm.

Suitable toner compositions are described in European patent applications EP-A-601235, and EP-A-628883 and International patent applications WO 94/27192, 94/27191 and 94/29770 (all Agfa-Gevaert NV). The glass transition temperatures of most common toner compositions are similar at about 55° C. Where the web carries a number of different toners, as for example in the case of multi-color images, the finishing element should make contact with the web while the web is at a temperature above the lowest glass transition temperature of the toners present, most preferably above the highest glass transition temperature of the toners present, and preferably break contact near the lowest glass transition temperature.

According to a second aspect of the invention, there is provided a method of forming a toner image on a web of receiving material, comprising:

feeding a web of receiving material along a web path;

forming at least one toner image on at least a first face of the receiving material as it is fed along the web path; and fixing the toner image onto the receiving material, characterized by thereafter contacting the first face of the receiving material with at least one finishing element while the top surface of the toner image is at a temperature above the glass transition temperature ($T_g$) of the toner, to modify the finish of the toner image.

In an embodiment of the printer according to the invention, means are provided to enable images to be produced selectively without a glossy appearance, where this may be desired. For example, in the case of finishing rollers which contact the receiving material before the temperature thereof falls below the glass transition temperature of the toner, means may be provided for selectively moving these rollers out of contact with the web. In the case of heated finishing rollers, means may be provided for selectively switching off the supply of heat energy thereto.

A number of fixing methods are known. The fixing means may take a variety of forms such as hot roller or radiant fixing.

For example, the web carrying the toner image is passed over heated rollers. A problem arises with such roller fixing, that if the temperature of the rollers is too high, toner is transferred from the receiving material to the surface of the rollers (an effect known as "hot-offset"), to be deposited on a following location on the receiving material, thereby producing the effect of "ghost" images. Ghosting can be reduced by continuously applying a release agent, such as a silicone oil, to the surface of the rollers, but this release agent represents a consumable material which adds to the running costs of the printer. If the temperature of the rollers is too low, the toner is insufficiently fixed to the paper and an effect known as "cold offset" can occur. After a period of time the heated rollers may become subject to wear. Also, due to the fact that heating occurs with contact with the receptor material, disadvantageous surface effects can occur. Furthermore, when the paper is in sheet form, the paper tends to adhere to the rollers and special paper stripping means need to be provided and the choice of materials for forming the surface of the rollers is limited.

Nevertheless, we have found that, where the web carries a toner image on one face only, i.e. so-called "simplex" printers, the fixing means may suitably be a heated fixing roller formed of a rigid material, e.g. a metal roller, having a surface coating of an abhesive material such as a silicone rubber, without the need to apply a release agent. An opposed pressure roller formed for example of rubber or an elastomeric material, is provided, biased towards the fixing roller to form a nip there-between through which the web passes. This fixing arrangement is particularly beneficial when the web comprises a low-melting point material, such as a plastics material commonly used as a substrate for printed labels, which is liable to stretch if passed through a radiant fixing device. The temperature of the heated fixing roller, which may be monitored by the use of an appropriately positioned sensor, may be so controlled as to incompletely fix the toner image, fixing being completed by contact with a heated finishing element.

A number of radiant fixing techniques are also known. In "flash-fixing" a short intense burst of radiant energy is applied to the receptor material carrying the toner image to be fixed. The wavelength of the radiant energy is chosen to be absorbed by the toner and is therefore in the visible or ultra-violet part of the spectrum. Such a technique is unsuitable for multi-color images, where toners of different composition are carried on the receptor material, said toners having different absorption characteristics in the visible spectrum.

A number of constructions of image fixing stations have been proposed in the art which use a radiant heat i.e. infra-red fixing technique. Thus, for example, European patent application EP-A-629930 (Xeikon NV) describes an image-fixing station for fixing the toner image on a moving receiving material, which comprises two pairs of radiant heat sources, the peak energy output wavelength of which lies in the non-visible part of the spectrum.

By the use of infra-red radiant fixing the whole receptor material i.e. not only the toner, becomes hot. Most receptor materials have a relatively high heat capacity and therefore take some time to cool. For this reason a cooling device, especially a non-contact cooling device is often provided downstream of the fixing station.

When the web of receiving material is formed of paper, a dangerous situation can arise in the event of a failure of the web drive, such as may occur if there is an electrical power failure. Even if electrical power to the infra-red radiant fixing device is cut at this time, a portion of the web stands in close proximity to the radiant elements which may retain significant heat for some time. There is therefore a risk that the web material will be damaged or may even catch fire, and further that such a fire may spread along the web to other parts of the printer.

An embodiment is described in European patent application EP-A-629930 (Xeikon NV) in which the radiant sources are located in hingedly mounted pairs of housings in such a manner that the housings may be moved into a closed position to shield the radiant sources from the web when the speed of movement of the web falls below a predetermined value. Damage to the web when movement thereof stops is thereby avoided.

We prefer to use a non-contact fixing method and in particular infra-red radiant fixing. The peak energy output wavelength of the radiant source preferably corresponds to an absorption wavelength of the receptor material, which in preferred embodiments of the invention comprises paper, which absorbs radiation strongly (i.e. absorbs more than 50% incident energy) over the range of 3 $\mu$m to at least 8 $\mu$m. Thereby, the toner particles are heated indirectly, from the heat energy absorbed by the receptor material, the heat energy being transferred from the receptor material by a combination of conduction and convection. Some heat energy will, of course, be absorbed directly by the toner particles, to a degree depending upon their composition. Thus, the radiant source may comprise one or more infrared emitting sources, causing the receptor material to be heated above the melting temperature of the toner particles, so that the latter melt and adhere thereto. Due to the fact that heating occurs without contact with the receptor material, calendaring effects are avoided. The radiant source preferably has a radiant energy output wavelength within the range of from 1 to 10 $\mu$m, such as within the range of from 3 to 6 $\mu$m.

The radiant heat sources may be provided along a relatively long trajectory of the receptor material, so that less restriction is placed upon the speed of the latter. Furthermore, smearing of the transferred toner image is also avoided. The infrared emitting radiant sources are preferably such as emit heat by the Joule-effect.

It is an additional objective of the invention, where infra-red radiant fixing is used, to reduce the risks of the spread of fire in the printer, in the event of a failure of web transport, whether the radiant fixing device is of the type described in EP-A-629930 or some other type.

Thus, according to a preferred feature of the invention, the fixing means comprises infra-red radiant fixing means comprising a fixer housing having a web inlet, a web outlet and infra-red radiant elements, and a finishing roller pair are located immediately downstream of the web outlet, through which the web path extends, and means are provided for moving the rollers of the finishing roller pair between an open position in which the rollers are not in contact with the receiving material and a closed position in which the rollers are in contact with the receiving material and are positioned to close the web outlet.

In this embodiment of the invention, the printer may further comprise means for automatically closing the finishing roller pair when movement of the web falls below a predetermined threshold, such as below 25% of nominal speed. This automatic closure of the fixer housing may also be triggered automatically in the event of a power failure.

One suitable embodiment is where the rollers are mounted on articulated arms, biasing means acting on the articulated arms being provided to bias the rollers towards each other and drive means acting on the articulated arms being provided to move the rollers away from each other. A releasable coupling may be provided between the drive means and the articulated arms, to decouple the drive means therefrom when movement of the web falls below a predetermined threshold.

A further roller pair may be positioned immediately upstream of the web inlet, through which the web path passes. This further roller pair may also be arranged to close when the web speed falls.

The arrangement whereby the finishing rollers can be moved between open and closed positions can be particularly beneficial when the finishing rollers are driven rollers, heated from outside. At start-up of the printer, the rollers may be retained in the open position while being heated up to operating temperature, and thereafter moved into the closed operating position.

PREFERRED EMBODIMENTS OF THE INVENTION

The invention will now be further described, purely by way of example, with reference to the accompanying drawings in which.

Figure 3:
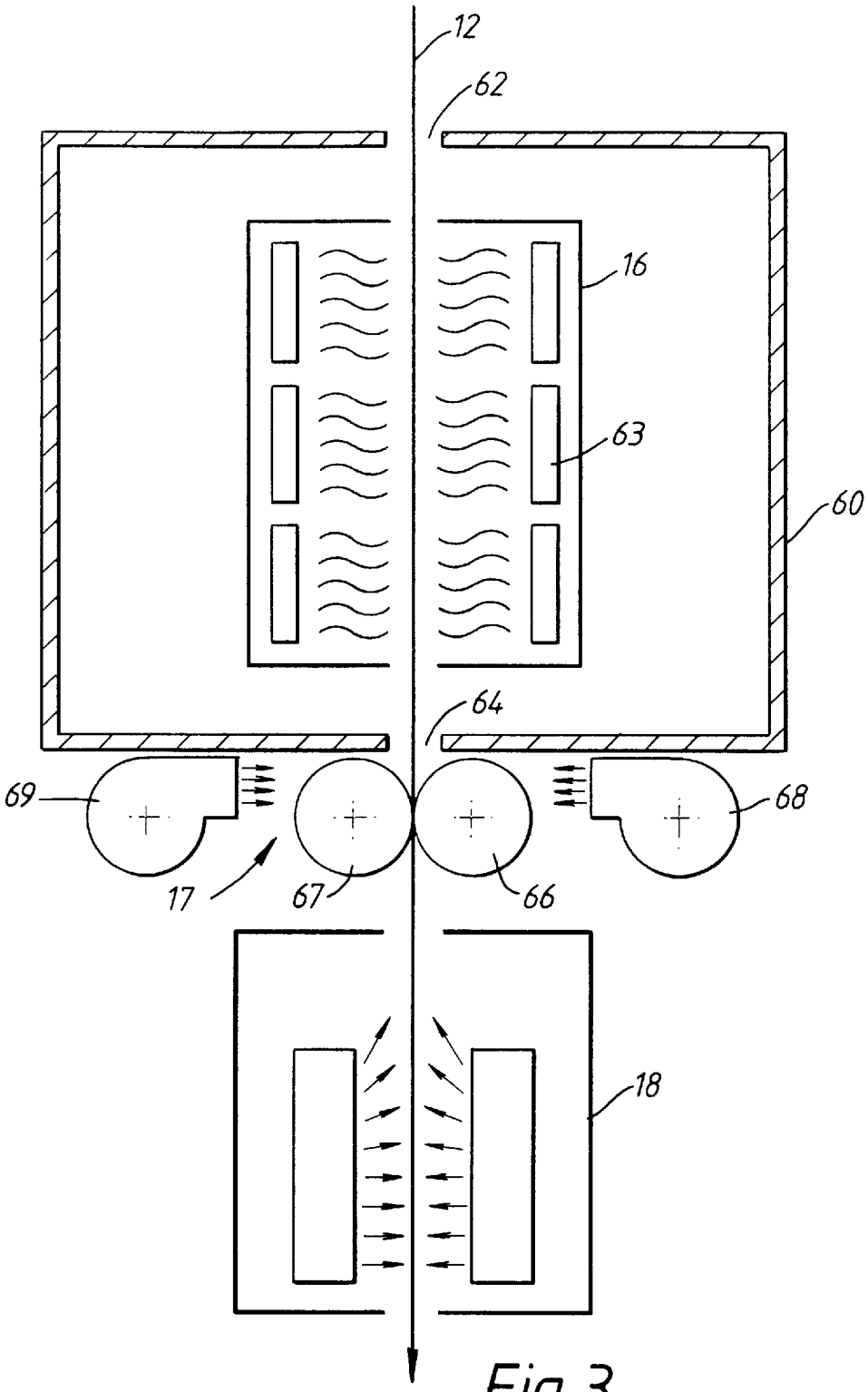
FIG. 3 shows details of the finishing station of the printer shown in FIGS. 1 and 2.
Figure 7A:
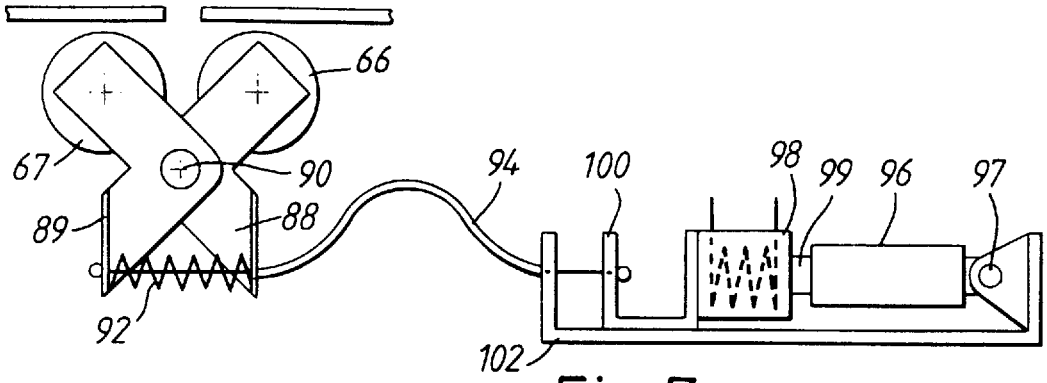
Figure 7B:
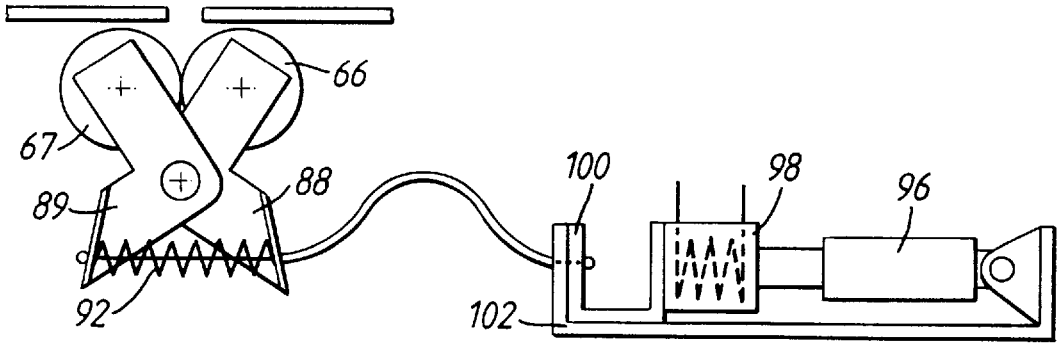
Figure 7C:
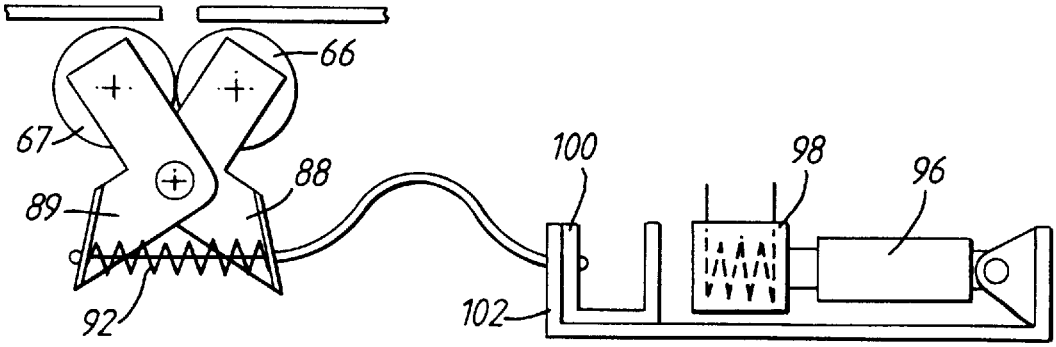
Figure 8:
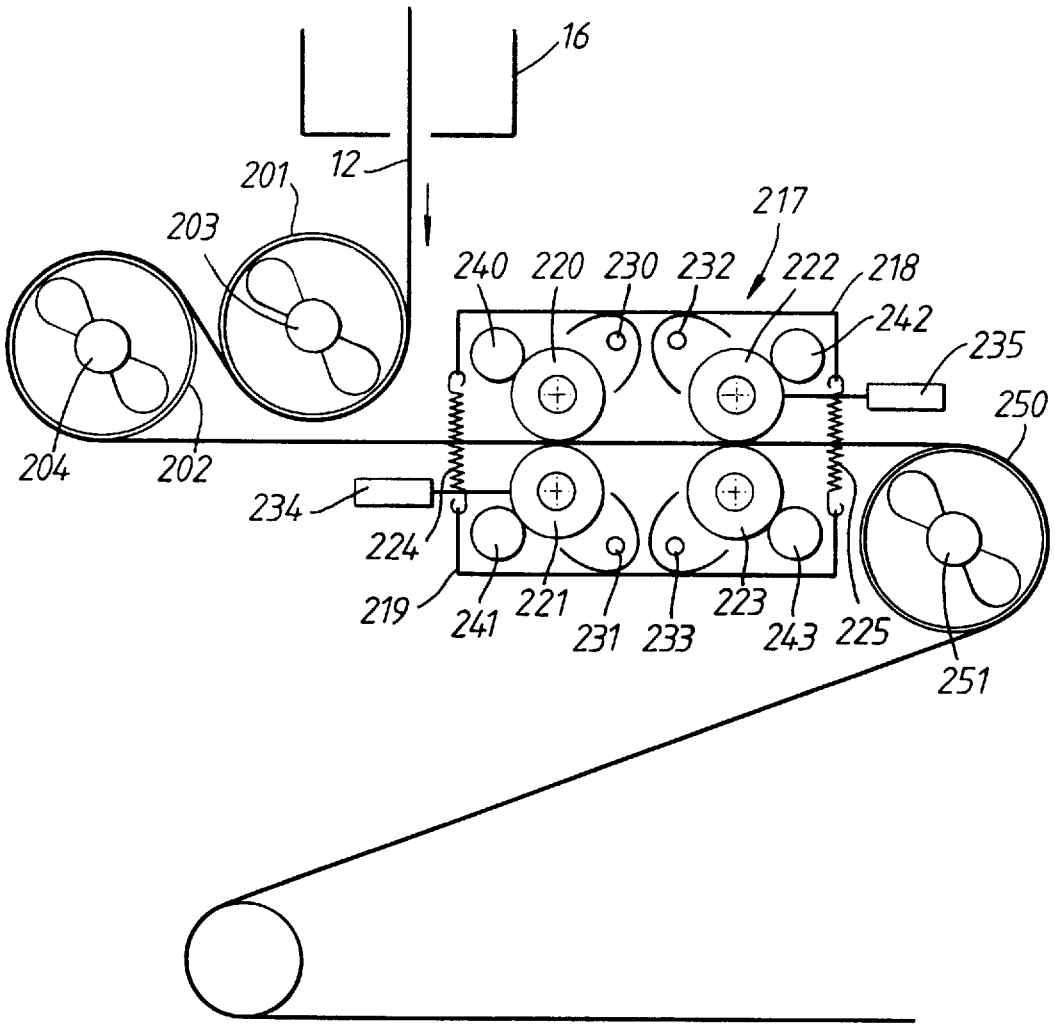
Figure 9:
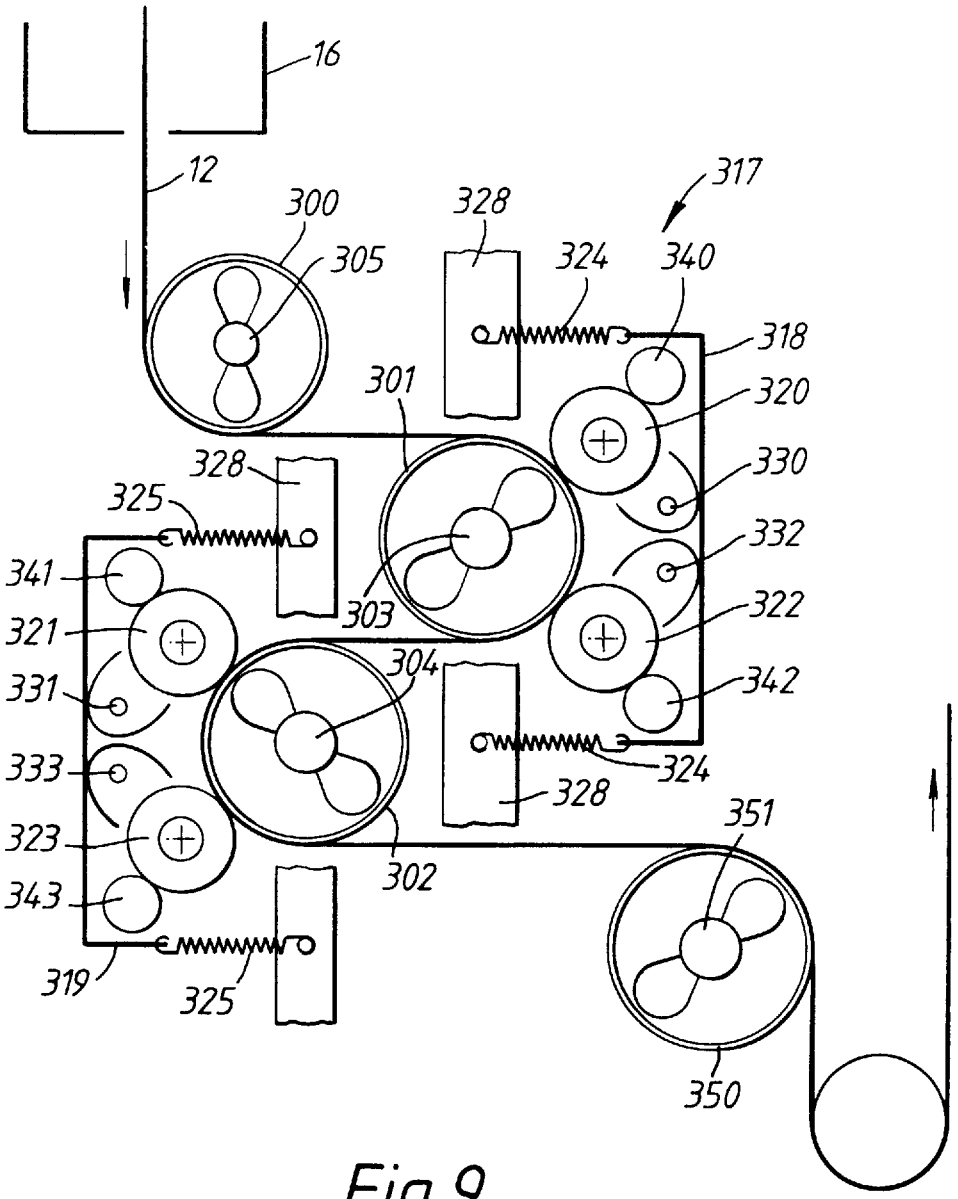

FIGS. 7*a*, 7*b* and 7*c* show details of the mounting and operating mechanism of the finishing station shown in FIG. 3, in different stages of operation;

FIG. 8 shows an alternative embodiment of a finishing station according to the invention; and FIG. 9 shows a modification of the embodiment shown in FIG. 8.

The printer 10 shown in the Figs. has a supply station 13 in which a roll 14 of web material 12 is housed, in sufficient quantity to print, say, up to 5,000 images. The web 12 is conveyed into a tower-like printer housing 44 in which support columns 46 and 46' are provided, each housing five similar printing stations A to E and A' to E'. The image-producing stations A, B, C and D and likewise A', B', C' and D' are arranged to print yellow, magenta, cyan and black images respectively. The stations E and E' are provided in order to optionally print an additional color, for example a specially customized color, for example white. Each sub-group of printing stations A to E and A' to E' are mounted in a substantially vertical configuration resulting in a reduced footprint. The columns 46 and 46' may be mounted against vibrations by means of a platform 48 resting on springs 50, 51. The columns 46 and 46' may be mounted on rails enabling their relative movement. In this way the columns may be moved away from each other for servicing purposes.

The web of paper 12 unwound from a supply roller 14 is conveyed in an upwards direction past the printing stations in turn. A brake 11 acts against the roller 14. After passing the last printing station E', the web of paper 12 passes over a reversing roller 150 and then downwards through an image-fixing station 16, a finishing station 17 (which for the sake of clarity is not shown in FIG. 1), a cooling station 18 and thence to a cutting station 20 to cut the web 12 into sheets and to a cut sheet stack 52. The web 12 is conveyed through the printer by two drive rollers 22*a*, 22*b* one positioned between the supply station 13 and the first image-producing station A and the second positioned between the cooling station 18 and the cutting station 20. The drive rollers 22*a*, 22*b* are driven by controllable motors, 23*a*, 23*b*. One of the motors 23*a*, 23*b* is speed controlled at such a rotational speed as to convey the web through the printer at the required speed, which may for example be about 125 mm/sec. The other motor is torque controlled in such a way as to generate a web tension of, for example, about 1 N/cm web width.

Figure 2:
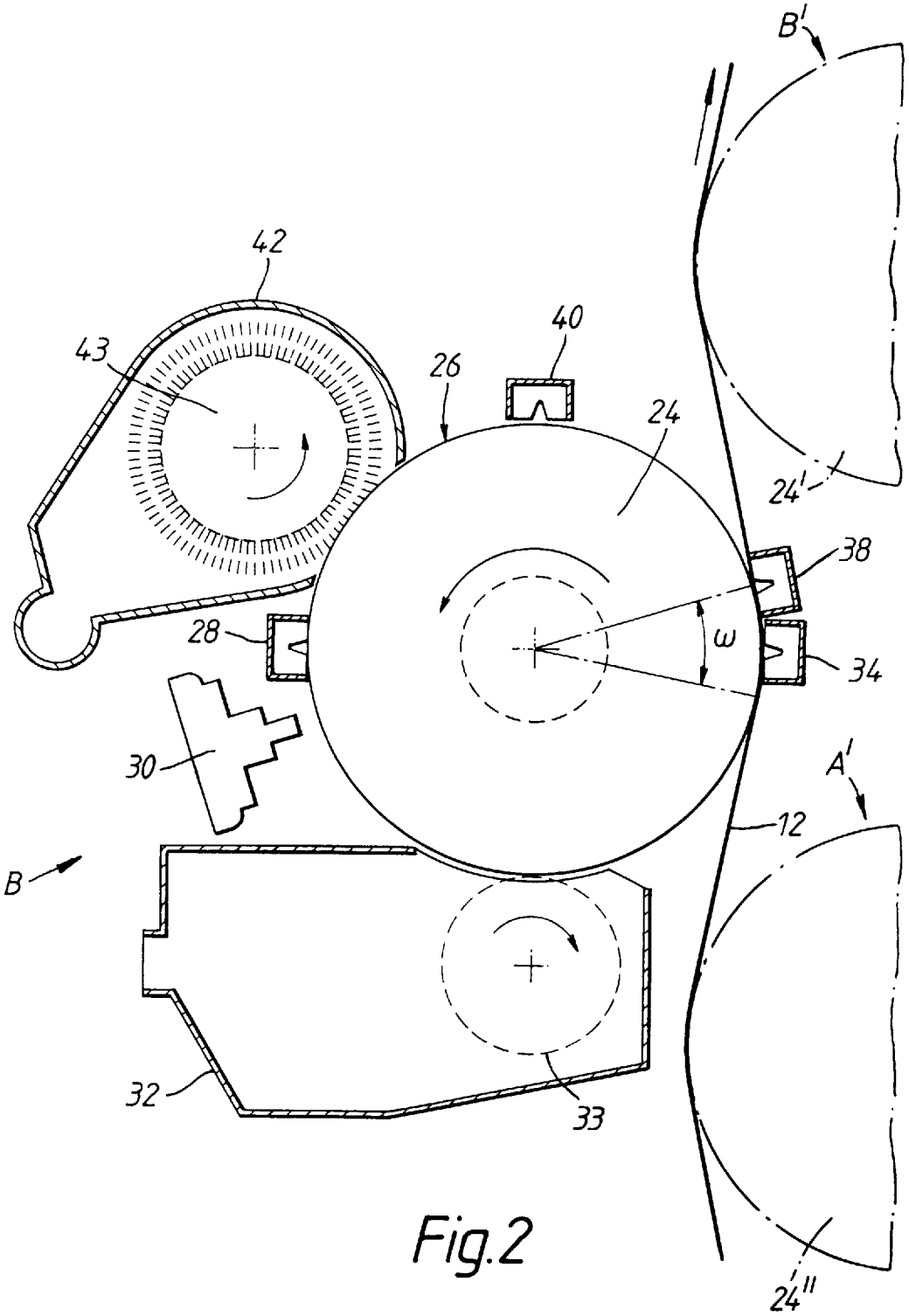
FIG. 2 shows in detail a cross-section of one of the print stations of the printer shown in FIG. 1.

As shown in FIG. 2, each image-producing station (e.g. printing station B) comprises a cylindrical drum 24 having a photoconductive outer surface 26. Circumferentially arranged around the drum 24 there is a main corotron or scorotron charging device 28 capable of uniformly charging the drum surface 26, for example to a potential of about −600V, an exposure station 30 which may, for example, be in the form of a scanning laser beam or an LED array, which will image-wise and line-wise expose the photoconductive drum surface 26 causing the charge on the latter to be selectively dissipated, for example to a potential of about −250V, leaving an image-wise distribution of electric charge to remain on the drum surface 26. This so-called "latent image" is rendered visible by a developing station 32 which by means known in the art will bring a developer in contact with the drum surface 26. The developing station 32 includes a developer drum 33 which is adjustably mounted, enabling it to be moved radially towards or away from the drum 24 for reasons as will be explained further below. In a typical construction of a developer station, the developer drum 33 contains magnets carried within a rotating sleeve causing the mixture of toner and magnetizable carrier particles to rotate therewith, to contact the surface 26 of the drum 24 in a brush-like manner. Negatively charged toner particles, triboelectrically charged to a level of, for example 9 $\mu$C/g, are attracted to the photo-exposed areas on the drum surface 26 by the electric field between these areas and the negatively electrically biased developer so that the latent image becomes visible.

Figure 1:
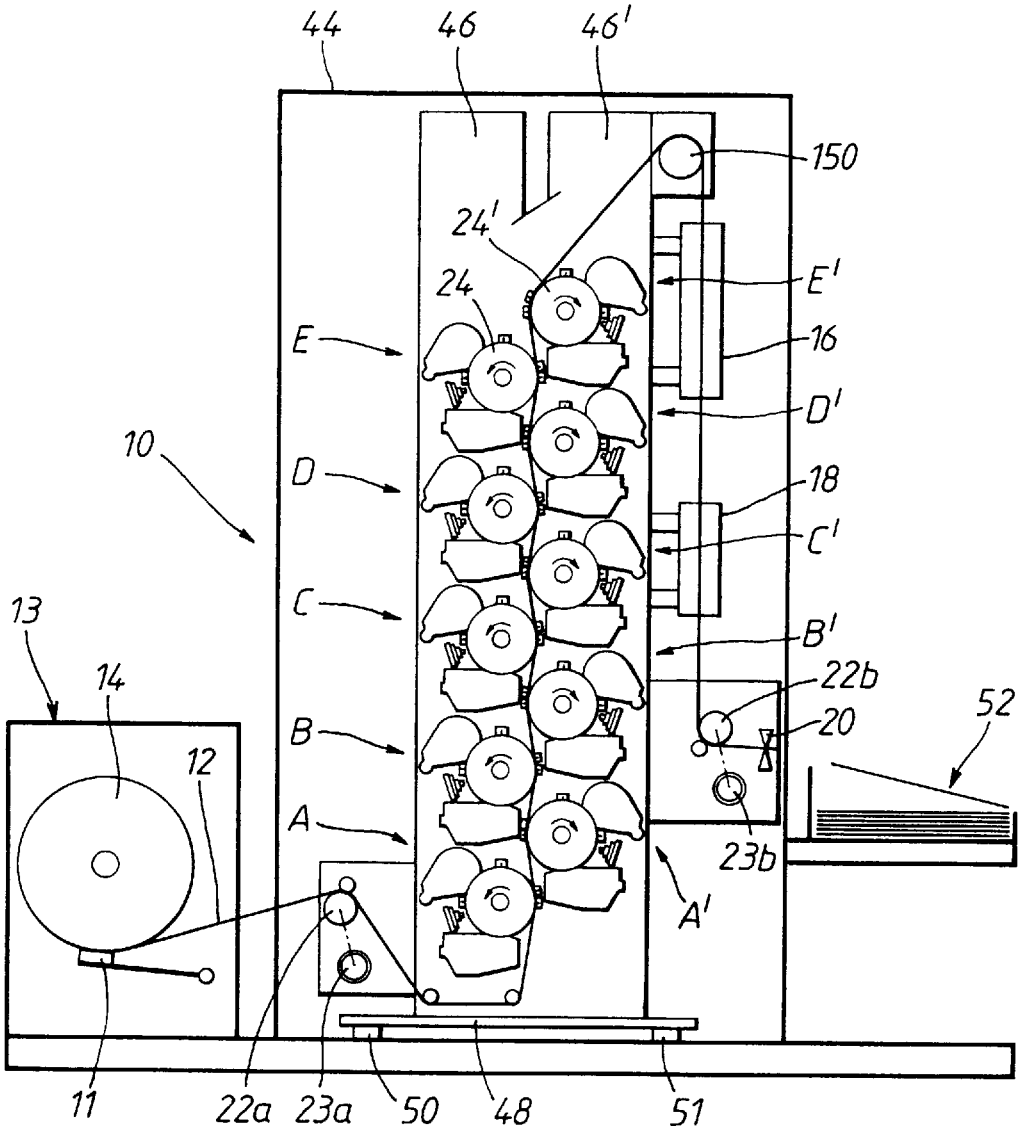
FIG. 1 shows a section of a printer according to an embodiment of the invention, capable of simultaneous duplex printing.

After development, the toner image adhering to the drum surface 26 is transferred to the moving web 12 by a transfer corona device 34. The moving web 12 is in face-to-face contact with the drum surface 26 over a wrapping angle $\omega$ of about 15° determined by the position of the drums 24' and 24" of the immediately adjacent opposed printing stations (e.g. printing stations A' and B'). As shown in FIG. 1, the columns 46 and 46' are mounted closely together so that the web 12 travels in a generally vertical path defined by the facing surfaces of the imaging station drums 24, 24'. This arrangement is such that each imaging station drum acts as the guide roller for each adjacent drum by defining the wrapping angle.

The transfer corona device, being on the opposite side of the web to the drum, and having a high potential opposite in sign to that of the charge on the toner particles, attracts the toner particles away from the drum surface 26 and onto the surface of the web 12. The transfer corona device typically has its corona wire positioned about 7 mm from the housing which surrounds it and 7 mm from the paper web. A typical transfer corona current is about 3 $\mu$A/cm web width. The transfer corona device 34 also serves to generate a strong adherent force between the web 12 and the drum surface 26, causing the latter to be rotated in synchronism with the movement of the web 12 and urging the toner particles into firm contact with the surface of the web 12. The web, however, should not wrap around the drum beyond the point dictated by the positioning of the drum of the next adjacent printing station and there is therefore provided circumferentially beyond the transfer corona device 34 a web discharge corona device 38 driven by alternating current and serving to discharge the web 12 and thereby allow the web to become released from the drum surface 26. The web discharge corona device 38 also serves to eliminate sparking as the web leaves the surface 26 of the drum.

Thereafter, the drum surface 26 is pre-charged to a level of, for example −580V, by a pre-charging corotron or scorotron device 40. The pre-charging makes the final charging by the corona 28 easier. Any residual toner which might still cling to the drum surface may be more easily removed by a cleaning unit 42 known in the art. Final traces of the preceding electrostatic image are erased by the corona 28. The cleaning unit 42 includes an adjustably mounted cleaning brush 43, the position of which can be adjusted towards or away from the drum surface 26 to ensure optimum cleaning. The cleaning brush is grounded or subject to such a potential with respect to the drum as to attract the residual toner particles away from the drum surface. After cleaning, the drum surface is ready for another recording cycle.

Referring to both FIGS. 1 and 2, after passing the first printing station A (of a printer 10—see FIG. 1), the web passes successively to image-producing stations B, C and D, where images in other colors are transferred to the web. It is critical that the images produced in successive stations be in register with each other. In order to achieve this, the start of the imaging process at each station has to be critically timed. However, accurate registering of the images is possible only if there is no slip between the web 12 and the drum surface 26.

The electrostatic adherent force between the web and the drum generated by the transfer corona device 34, the wrapping angle ω determined by the relative position of the drum 24 and the drums 24' and 24", and the tension in the web generated by the drive roller 22 and the braking effect of the brake 11 are such as to ensure that the rotational speed of the drum 24 is determined substantially only by the movement of the web 12, thereby ensuring that the drum surface moves synchronously with the web.

The cleaning unit 42 includes a rotatable cleaning brush 43 which is driven to rotate in a sense the same as that of the drum 24 and at a peripheral speed of, for example twice the peripheral speed of the drum surface. The developing unit 32 includes a brush-like developer drum 33 which rotates in the opposite sense to that of the drum 24. The resultant torque applied to the drum 24 by the rotating developing brush 33 and the counter-rotating cleaning brush 43 is adjusted to be close to zero, thereby ensuring that the only torque applied to the drum is derived from the adherent force between the drum 24 and the web 12. Adjustment of this resultant force is possible by virtue of the adjustable mounting of the cleaning brush 43 and/or the developing brush 33 and the brush characteristics.

FIG. 3 shows details of one embodiment of a finishing station 17, which is positioned between the image fixing station 16 and the cooling station 18.

As shown in FIG. 3, the image fixing station comprises a housing 60, which constitutes a fire wall, the housing having an upper web inlet 62, a lower web outlet 64 and controllable radiant elements 63. Positioned immediately downstream of the web outlet 64 is a pair of finishing rollers 66, 67, which are biased together by means not shown in FIG. 3, to form a nip through which the web 12 passes. The finishing rollers 66, 67 are cooled by controllable cold air fans 68, 69 respectively.

As it leaves the fixing station 16 the web 12 is at a temperature above the glass transition temperature $T_g$ of the toner which makes up the image thereon. Toner on the faces of the web contacts the finishing rollers 66, 67 where the surface characteristics thereof become modified to increase the gloss and improve the color saturation.

Figure 4:
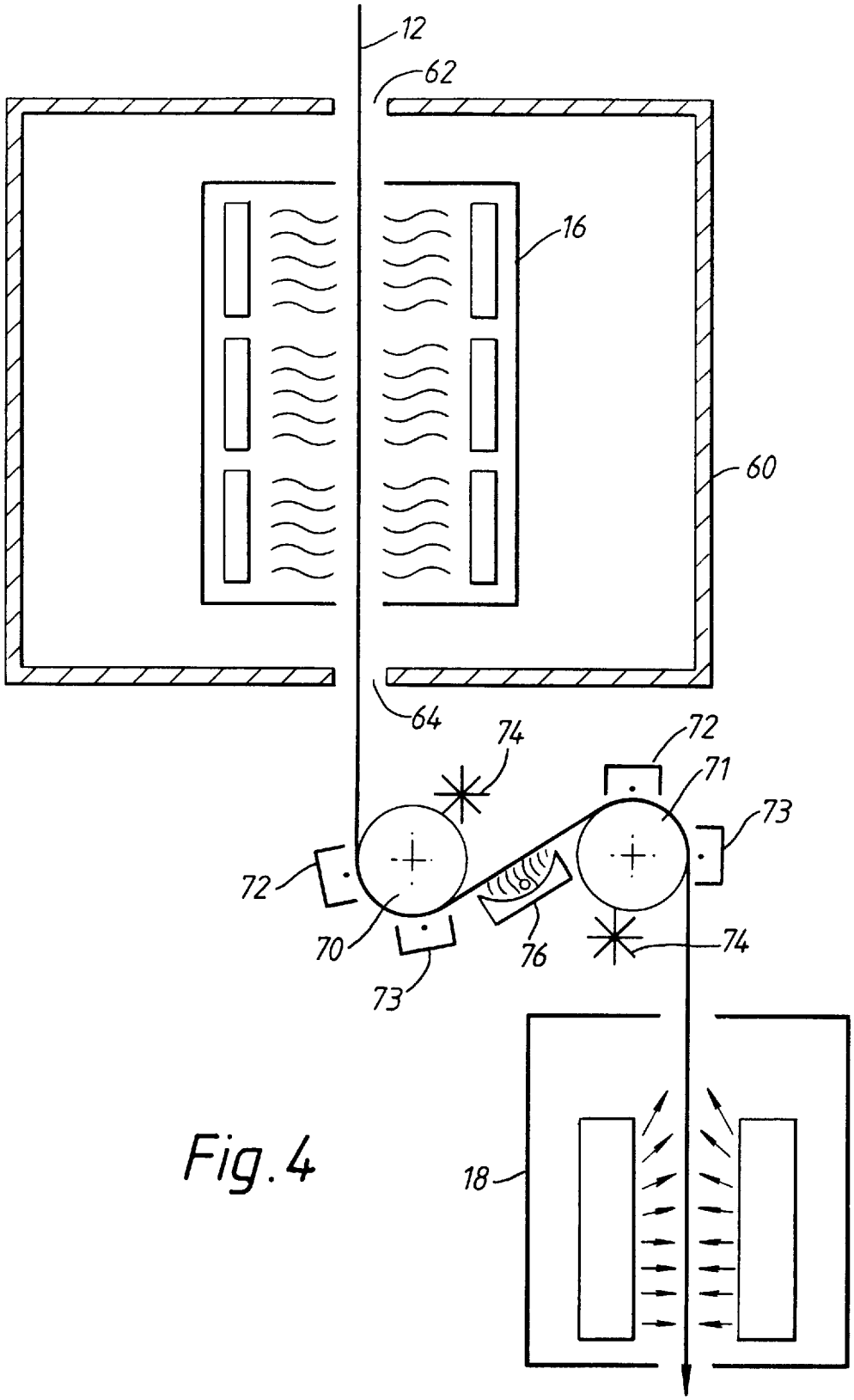
FIG. 4 shows details of a finishing station of a printer according to an alternative embodiment of the invention.
Figure 5:
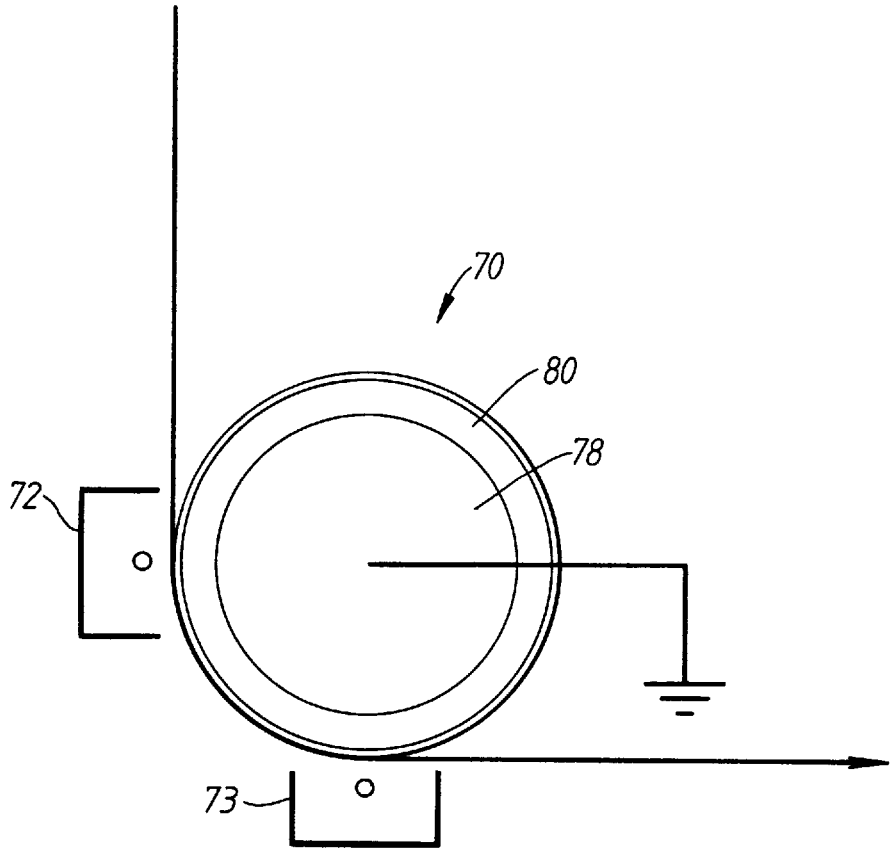
FIG. 5 shows details of the finishing roller of the finishing station shown in FIG. 4.

In the alternative embodiment shown in FIG. 4, the web 12 leaving the outlet 64 of the fixer housing 60, follows a serpentine path between two spaced apart finishing rollers 70, 71 en route to the cooling station 18. As further shown in FIG. 5, the finishing roller 70 comprises a grounded metallic (e.g. stainless steel) core 78 provided with a, preferably conductive, elastomeric covering 80, for example formed of silicone rubber, which may in turn carry a coating of polytetrafluoroethylene, or other low friction material. A DC corona device 72 operating at a voltage of about 2 kV with a current of about 10 to 100 $\mu$A establishes a charge on the adjacent face of the web 12, which serves to attract the web towards the finishing roller 70, thereby increasing the pressure applied by that finishing roller to the web. An AC corona 73, operating at say 15 kV, removes the charge from the web 12 as it breaks contact with the finishing roller 70. The finishing roller 71 is similarly constructed and arranged. As shown in FIG. 4, each of the finishing rollers 70, 71 may be provided with a rotating brush 74 which serves to remove any stray toner particles which may become adhered to the roller surface, or may alternatively be used to apply a release agent to the roller surface.

As it leaves the fixing station 16 the web 12 is at a temperature above the glass transition temperature $T_g$ of the toner which makes up the image thereon. Toner on the right hand face of the web as viewed in FIG. 4 contacts the finishing roller 70 where the surface characteristics thereof become modified to increase the gloss and improve the color saturation. Toner on the left hand face of the web remains substantially unaffected. Since the web leaves the finishing roller 70 at a temperature which is below $T_g$, an intermediate heating device 76 is provided to increase the web temperature above $T_g$ before the toner which makes up the image on the left hand side of the web contacts the finishing roller 71, where its surface characteristics are similarly modified.

Figure 6:
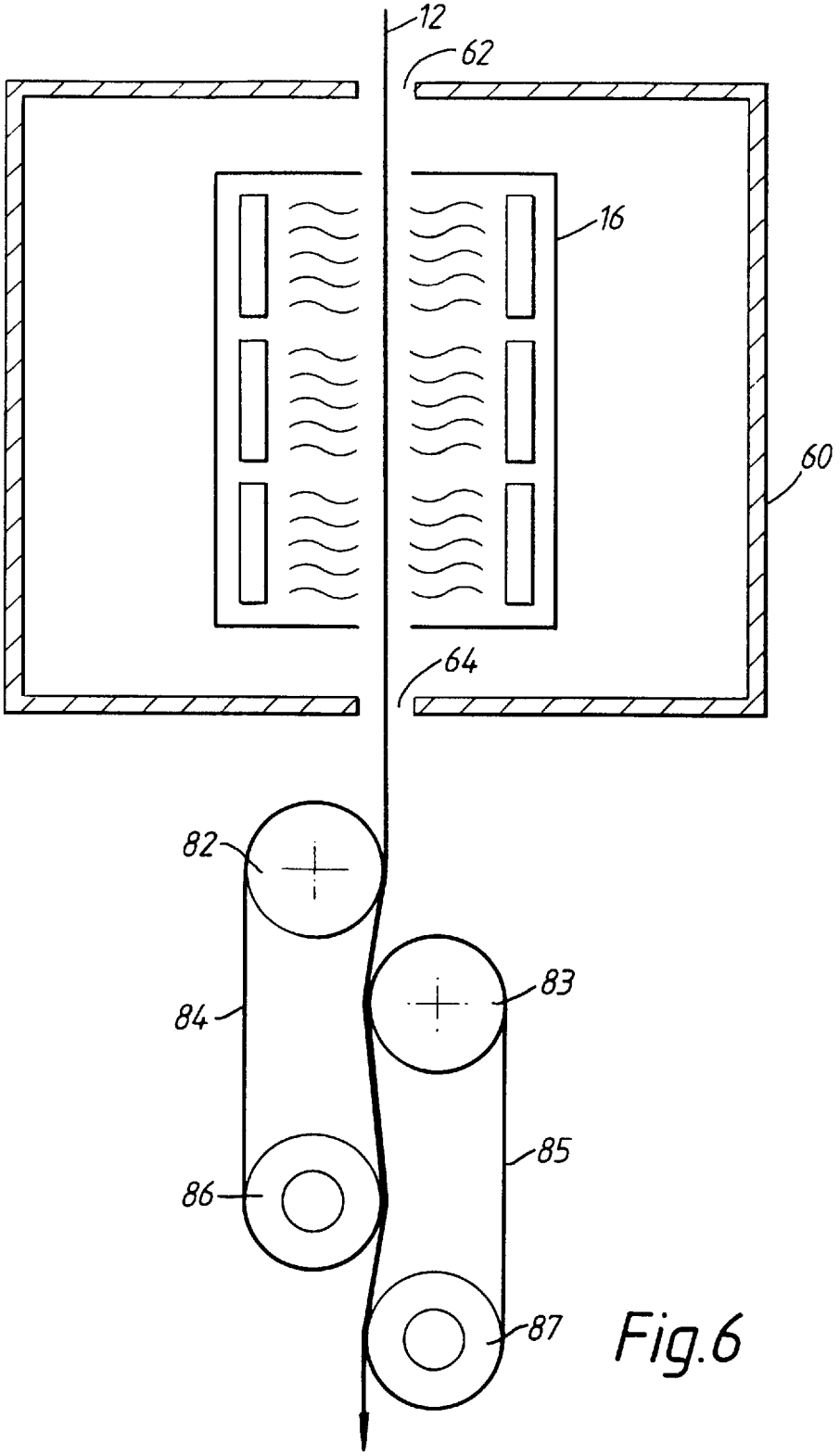
FIG. 6 shows details of a finishing station according to a further alternative embodiment of the invention.

In the embodiment shown in FIG. 6, positioned immediately downstream of the web outlet 64 is a pair of finishing belts 84, 85 which pass over upper controllably heated rollers 82, 83 and lower cooled rollers 86, 87 respectively. The geometric arrangement of these belt-supporting rollers is such as to establish pressurized contact between the belts 84 and 85. Alternatively, a pair of intermediate pressure rollers biased together to form a nip through which the finishing belts 84, 85 pass, may be provided. The belts are formed of metal such as stainless steel, provided with a PTFE coating, or of a heat conductive polymer such as KAPTON (Trade Mark ex Dupont Corp.).

As it leaves the fixing station 16 the web 12 is at a temperature above the glass transition temperature $T_g$ of the toner which makes up the image thereon. Toner on the faces of the web contacts the finishing belts 84, 85 where the surface characteristics thereof become modified to increase the gloss and improve the color saturation. The use of finishing belts in the embodiment shown in FIG. 6, rather than finishing rollers, provides a longer contact time and thereby a higher gloss is imparted to the toner image.

Referring to FIGS. 7*a*, 7*b* and 7*c*, the finishing rollers 66, 67 are shown mounted on articulated arms 88, 89, pivoted together at a pivot point 90 in a scissors-like arrangement. A spring 92 urges the lower ends of the arms 88, 89 away from each other to bias the rollers 66, 67 into contact. A Bowden cable 94 is operatively connected to the arms 88, 89. While FIGS. 7*a*, 7*b* and 7*c*, show the arrangement at only one end of the rollers 66, 67 it is to be understood that the arrangement at the other end is similar. The Bowden cables from both ends are operatively connected to an actuating device 102. The actuating device 102 comprises a linear drive motor 96, which is fixed at a point 97 and has a moving shaft 99. The shaft 99 carries a solenoid operated coupling device 98, which is such that when current flows through the solenoid thereof a slidable U-shaped frame 100 is attracted thereto. The frame 100 is connected to both Bowden cables 94.

A control device (not shown) is provided for sensing movement of the web 12 and cutting power to the coupling device 98 if the web speed should fall below a pre-set threshold, such as 25% of nominal speed.

FIGS. 7*a* and 7*b* show two normal operating positions, in both of which current is flowing through the solenoid of the coupling device 98. In FIG. 7*a*, the drive device 96 has been operated to retract the shaft 99, pulling the frame 100 to the right as shown, causing the Bowden cable to pull the arms 88, 89 together, against the force of the spring 92, thereby opening the rollers 66, 67. This position corresponds to an image non-finishing mode of the printer.

In FIG. 7*b*, the drive device 96 has been operated to extend the shaft 99, urging the frame 100 to the left causing the Bowden cable to release the arms 88, 89, thereby allowing the rollers 66, 67 to close under the force of the spring 92. This position corresponds to the image finishing mode of the printer.

FIG. 7*c* shows the position when movement of the web 12 has fallen below the predetermined threshold, or there has been a power failure. In this position, current has ceased to flow through the solenoid of the coupling device 98 and the frame 100 has therefore been released therefrom. This allows the frame 100 to slide to the left causing the Bowden cables to release the arms 88, 89, thereby allowing the rollers 66, 67 to close under the force of the springs 92. The outlet 64 of the fixer housing is thereby closed. This position corresponds to the safety shut-down mode of the printer, any fire in the fixer housing being safely retained therein.

In the alternative embodiment shown in FIG. 8, the web 12 leaving the fixing station 16, at a temperature of, for example 110° to 150° C., passes over a pair of cooling rollers 201, 202, whereby each face of the web is cooled sufficiently to prevent hot offset, for example so as to bring the temperature of the toner image thereon below the glass transition temperature of the toner, for example below 65° C. These cooling rollers are hollow grounded stainless steel rollers carrying a conductive elastomeric coating of silicone rubber, fans 203, 204 being provided to blow cold air through the interiors thereof.

The web 12 now enters a finishing station 217. The finishing station 217 comprises two housing parts 218, 219. A first pair of finishing rollers 220, 221 are provided at the entry of the finishing station and a second pair of finishing rollers 222, 223 are provided at the exit of the finishing station. The finishing rollers 220, 222 are carried in one housing part 218, while the finishing rollers 221, 223 are carried in the other housing part 219. The housing parts 218, 219 are biased towards each other by springs 224, 225, thereby biasing the finishing rollers of each pair into contact with each other to form a nip through which the web 12 extends.

Each finishing roller 220, 221, 222 and 223 is provided respectively with a radiant heater 230, 231, 232, 233 to which electrical power is controllably supplied by means not shown, the radiant heaters each having a heat output under steady state conditions of from 50 to 200 watts. Temperature sensors 234, 235 are provided to measure the temperature of the surface of at least one finishing roller of each pair. These temperature sensors are coupled to the controllable power supply means for the radiant heaters 230, 231, 232, 233. Each finishing roller 220, 221, 222 and 223 is also provided respectively with an optional lubricating roller 240, 241, 242, 243 for applying a release agent, such as a silicone oil, to the surface of the finishing rollers. The temperature of the surface of the finishing rollers 220, 221, 222 and 223 is so controlled as to contact the surface of the web 12 at a temperature above the glass transition temperature $T_g$ of the toner to modify the finish of the toner image. For example, the temperature of the first pair of finishing rollers 220, 221 is from 80° to 110° C., while the temperature of the second pair of finishing rollers 222, 223 is from 90° to 120° C. In order to prevent hot offset at the second pair of finishing rollers, 222, 223, it is important that the temperature of the surface of these finishing rollers is above that of the top surface of the toner image. Although some cooling of the toner image can be expected between the first and second pairs of finishing rollers, we prefer to ensure that hot offset is prevented by setting the temperature of the second pair of finishing rollers slightly above that of the first pair.

After leaving the finishing station 217, the web 12 passes over a further hollow cooling roller 250, to cool the toner image to, for example, below 65° C., the cooling roller 250 being provided with a fan 251 to blow cold air through the interior thereof.

The embodiment shown in FIG. 9 is somewhat similar to that shown in FIG. 8, but with a different spacial arrangement.

In the alternative embodiment shown in FIG. 9, the web leaving the fixing station 16 firstly passes over an advance cooling roller 300, whereby one face of the web is cooled sufficiently to prevent hot offset, for example so as to bring the temperature of the toner image thereon below the glass transition temperature of the toner, for example below 65° C. The web then enters the finishing station 317 which comprises two housing parts 318, 319, in each of which can be found a pair of finishing rollers biased towards an opposed cooling roller carried on a fixed frame of the apparatus. Thus the housing part 318 comprises finishing rollers 320, 322 biased towards an opposed cooling roller 301 to form nips through which the web 12 extends. The first housing part 318 is biased towards the fixed frame 328 of the apparatus (only partly shown) by springs 324.

Each finishing roller 320, 321 is provided respectively with a radiant heater 330, 332, each with a steady state output of 50 to 200 watts, to which electrical power is controllably supplied by means not shown. Each finishing roller 320, 321 is also provided with an optional lubricating roller 340, 342 for applying a release agent, such as silicone oil, to the surface of the finishing rollers. The temperature of the surface of the finishing rollers 320 and 322 is so controlled, for example to 80° to 110° C. and to 90° to 120° C. respectively, as to contact the surface of the web 12 at a temperature above the glass transition temperature $T_g$ of the toner to modify the finish of the toner image.

The web 12 leaving the first part of the finishing station now passes over a second cooling roller 302, whereby the opposite face of the web is cooled sufficiently to prevent hot offset, for example so as to again bring the temperature of the toner image on the web below the glass transition temperature of the toner, for example below 65° C. The cooling roller 302 is carried on the fixed frame of the apparatus opposite to the second housing part 319 of the finishing station 317. Finishing rollers 321, 323 are carried in the second housing part 319. The second housing part 319 is biased towards the fixed frame 328 of the apparatus by springs 325, thereby biasing the finishing rollers 321, 323 into contact with the second cooling roller 302 to form nips through which the web 12 extends.

Each finishing roller 321, 323 is provided respectively with a radiant heater 331, 333, each with a steady state output of 50 to 200 watts, to which electrical power is controllably supplied by means not shown. Each finishing roller 321, 323 is also provided respectively with an optional lubricating roller 341, 343 for applying a release agent, such as a silicone oil, to the surface of the finishing rollers. The temperature of the surface of the finishing rollers 321 and 323 is so controlled, for example to 80° to 110° C. and to 90° to 120° C. respectively, as to contact the surface of the web at a temperature above the glass transition temperature $T_g$ of the toner to modify the finish of the toner image.

The cooling rollers 300, 301, 302 are hollow rollers, fans 305, 303, 304 respectively being provided to blow cold air through the interiors thereof.

The present invention is directed not only to printers in which the toner image forming device is provided with image information in an electronic form, but also to devices in which the toner image forming device is provided with image information in optical form, such devices being referred to in the art as printers or copiers depending upon their application. In the context of the present invention, the term "printer" is to be construed accordingly.

In the most preferred embodiment of the invention, the fixing station uses a non-contact fixing device, because this leads to a longer high quality lifetime than contacting devices. The web of receiving material is cooled after passing through the fixing station in order to strongly bond the toner to the receiving material. In the finishing station where heat and pressure are applied, only the top surface of the toner image reaches the softening temperature, thereby removing the peaks and filling the valleys in that surface, leading to the desired more glossy appearance. The heating of the toner surface in the finishing station is insufficient to extend through the entire bulk of the toner, so that weakening of the bond between the toner and the receiving material, which could lead to hot offset, is avoided. The heat transfer in the finishing station is therefore less than that in the fixing station. The rollers in the finishing station are freely rotating rollers, driven by movement of the web, although the use of directly driven rollers is also possible.

We claim:

1. An electrostatographic printer comprising:

means for feeding a web of receiving material along a web path;

a toner image forming device for forming a toner image, with toner having a glass transition temperature, on at least a first face of said receiving material as it is fed along said web path;

fixing means for fixing said toner image onto said receiving material;

at least one finishing element positioned immediately downstream of said fixing means, to contact said first face of said receiving material while a contacting surface of said toner image is at a temperature above said glass transition temperature to impart a modified finish to said toner image; and cooling means for cooling said finishing element.

2. The electrostatographic printer according to claim 1, further comprising web cooling means positioned downstream of said finishing element.

3. The electrostatographic printer according to claim 1, wherein said finishing element is provided with an adhesive web-contacting surface coated with polytetrafluoroethylene.

4. The electrostatographic printer according to claim 1, wherein said finishing element is an endless surface, selected from a surface of a roller and a continuous belt.

5. The electrostatographic printer according to claim 1, wherein said finishing element comprises a surface of a roller having a rigid core provided with a covering of elastomeric material.

6. The electrostatographic printer according to claim 1, wherein said finishing element is a freely rotating roller.

7. A method of forming a toner image on a web of receiving material, comprising:

feeding a web of receiving material along a web path;

forming a toner image, with toner having a glass transition temperature, on at least a first face of said receiving material as it is fed along said web path;

fixing said toner image onto said receiving material by exposure to radiation;

cooling said receiving material using cooling means; and thereafter contacting said first face of said receiving material with at least one heated finishing element, while a contacting surface of said finishing element is at a temperature which causes the temperature of said toner image to be above said glass transition temperature of said toner, to impart a modified finish to said toner image.

8. The method according to claim 7, wherein said finishing element is heated by external heating means to heat said contacting surface thereof.

9. The method according to claim 7, wherein at least first and second pairs of said finishing elements are used, said finishing elements of each pair being biased towards each other to define a nip therebetween, through which said web path extends, said finishing elements of said second pair being heated to a temperature higher than that of the finishing elements of said first pair.

10. An electrostatographic printer comprising:

means for feeding a web of receiving material along a web path;

a toner image forming device for forming a toner image, with toner having a glass transition temperature, on at least a first face of said receiving material as it is fed along said web path;

fixing means for fixing said toner image onto said receiving material; and first and second finishing rollers positioned downstream of said fixing means, to contact said first face of said receiving material while a contacting surface of said toner image is at a temperature above said glass transition temperature to impart a modified finish to said toner image, wherein said first finishing roller is provided upstream of said second finishing roller, said web taking a serpentine path around said finishing rollers.

11. The electrostatographic printer according to claim 10, further comprising heating means positioned between said first finishing roller and said second finishing roller.

12. An electrostatographic printer comprising:

means for feeding a web of receiving material along a web path;

a toner image forming device for forming a toner image, with toner having a glass transition temperature, on at least a first face of said receiving material as it is fed along said web path;

fixing means for fixing said toner image onto said receiving material; and a finishing device positioned downstream of said fixing means, to contact said first face of said receiving material while a contacting surface of said toner image is at a temperature above said glass transition temperature to impart a modified finish to said toner image, wherein said finishing device comprises a pair of finishing belts each of which passes over a respective upstream heated roller and a downstream cooled roller, so arranged to establish contact between said finishing belts.

13. An electrostatographic printer comprising:

means for feeding a web of receiving material along a web path;

a toner image forming device for forming a toner image, with toner having a glass transition temperature, on at least a first face of said receiving material as it is fed along said web path;

fixing means for fixing said toner image onto said receiving material;

at least one finishing element positioned downstream of said fixing means, to contact said first face of said receiving material while a contacting surface of said toner image is at a temperature above said glass transition temperature to impart a modified finish to said toner image; and heating means external to said finishing element to heat a web-contacting surface thereof, said heating means having a controllable heat output.

14. An electrostatographic printer comprising:

means for feeding a web of receiving material along a web path;

a toner image forming device for forming a toner image, with toner having a glass transition temperature, on at least a first face of said receiving material as it is fed along said web path;

fixing means for fixing said toner image onto said receiving material;

cooling means positioned downstream of said fixing means to cool a contacting surface of said toner image; and at least one heated finishing element positioned downstream of said cooling means, to contact said first face of said receiving material while a contacting surface of said finishing element is at a temperature which causes the temperature of said toner image to be above said glass transition temperature to impart a modified finish to said toner image.

15. An electrostatographic printer comprising:

means for feeding a web of receiving material along a web path;

two toner image forming devices for forming toner images, each said forming device positioned on either side of said web path, with toner having a glass transition temperature, on both faces of said receiving material as it is fed along said web path;

fixing means for fixing said toner images onto said receiving material; and two pairs of finishing elements positioned downstream of said fixing means, to contact said faces of said receiving material while a contacting surface of each said toner image is at a temperature above said glass transition temperature to impart a modified finish to each said toner image, said web path extending between said finishing elements of each said pair.

16. The electrostatographic printer according to claim 15, wherein said finishing elements of said second pair are heated to a temperature higher than that of the finishing elements of said first pair.

* * * * *